US012478181B1

(12) United States Patent
Wang

(10) Patent No.: US 12,478,181 B1
(45) Date of Patent: Nov. 25, 2025

(54) ADJUSTABLE DRAWER

(71) Applicant: Hongyan Wang, Sichuan (CN)

(72) Inventor: Hongyan Wang, Sichuan (CN)

( * ) Notice: Subject to any disclaimer, the term of this patent is extended or adjusted under 35 U.S.C. 154(b) by 0 days.

(21) Appl. No.: 18/923,887

(22) Filed: Oct. 23, 2024

Related U.S. Application Data

(63) Continuation-in-part of application No. 29/962,071, filed on Sep. 10, 2024.

(51) Int. Cl.
*A47B 88/90* (2017.01)
*A47B 45/00* (2006.01)

(52) U.S. Cl.
CPC ..... *A47B 88/941* (2017.01); *A47B 45/00* (2013.01)

(58) Field of Classification Search
CPC ..... A47B 45/00; A47B 88/941
USPC ..... 312/205, 348, 1, 348.2, 348.1
See application file for complete search history.

(56) References Cited

U.S. PATENT DOCUMENTS 1,746,720 A * 2/1930 Sullivan ..... A47F 3/14 220/8
2,627,801 A * 2/1953 Danziger ..... A21B 3/13 249/DIG. 1
2,907,487 A * 10/1959 Harrington ..... A47B 88/90 220/8
2,948,624 A * 8/1960 Watson ..... B65D 5/32 229/101
3,272,583 A * 9/1966 Averdieck ..... A47B 88/90 312/334.38
3,463,343 A * 8/1969 Asenbauer ..... B65D 21/0213 220/532
5,016,772 A * 5/1991 Wilk ..... B65D 21/086 220/495.11
5,192,019 A * 3/1993 Meehan ..... B65D 5/324 229/101
7,594,706 B2 * 9/2009 Styka ..... A47B 45/00 312/348.1
8,608,262 B1 * 12/2013 Daros ..... A47B 45/00 312/348.2
8,807,355 B2 * 8/2014 Merey ..... A47B 97/00 312/348.3
9,408,498 B2 * 8/2016 Sekora ..... A47J 37/1295
9,624,000 B1 * 4/2017 McLaughlin ..... A47D 15/00

* cited by examiner

*Primary Examiner* — James O Hansen
(74) *Attorney, Agent, or Firm* — HOWARD M COHN and Associates, LLC

(57) ABSTRACT

An adjustable drawer is disclosed in the present disclosure. The adjustable drawer includes a drawer body; the drawer body includes a plurality of connecting elements; the plurality of connecting elements join together and form a drawer configuration, at least one of the plurality of connecting elements is movable along a width direction of the drawer body for adjustment, at least one of the plurality of connecting elements is movable along a length direction of the drawer body for adjustment, and the drawer body is expandable or contractible. The present disclosure provides the adjustable drawer capable of adjusting a length and width of the drawer to match various cabinets.

17 Claims, 6 Drawing Sheets

ADJUSTABLE DRAWER

FIELD

The present disclosure relates to the field of home furnishings, and more particularly, to an adjustable drawer.

BACKGROUND

In each household, cabinets with drawers are custom-made based on a size and layout of a room. Due to different types of the cabinets, such as office desk cabinets, kitchen cabinets, wardrobes, and pantry cabinets, space available for drawers in each cabinet is inconsistent. Thus, drawers with different widths and lengths are required to be customized to match corresponding cabinets.

SUMMARY

An adjustable drawer is disclosed in the present disclosure. The adjustable drawer includes a drawer body; the drawer body includes a plurality of connecting elements; the plurality of connecting elements join together and form a drawer configuration, at least one of the plurality of connecting elements is movable along a width direction of the drawer body for adjustment, at least one of the plurality of connecting elements is movable along a length direction of the drawer body for adjustment, and the drawer body is expandable or contractible.

REFERENCE NUMERALS IN THE DRAWINGS

Figure 1:
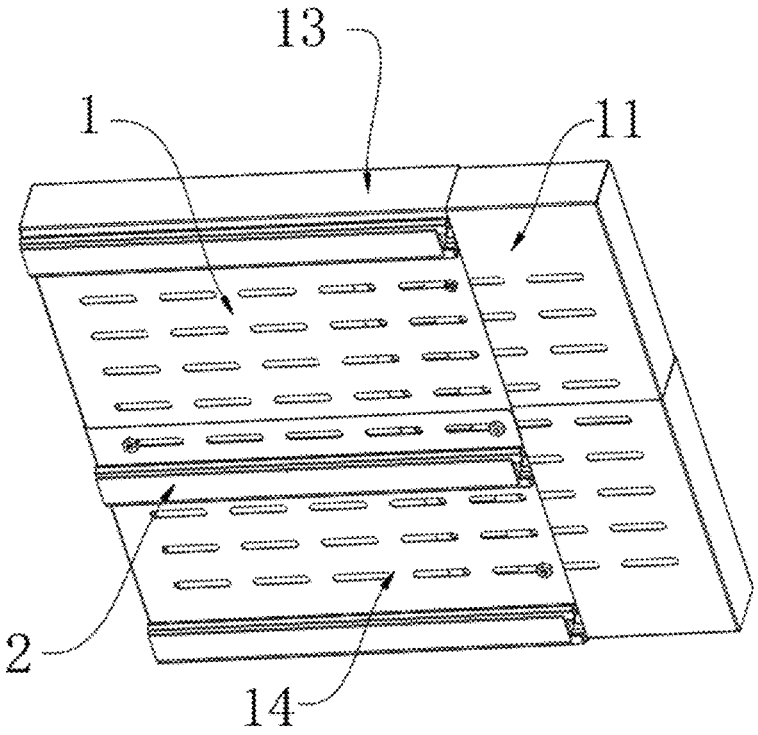
FIG. 1 is a structural view of an adjustable drawer according to an embodiment of the present disclosure.

1—drawer body; 11—connecting element; 2—sliding rail; 12—connecting portion; 129—first stacking portion; 123—second stacking portion; 112—bottom portion; 111—outer edge; 14—bottom face; 13—side face; 124—first opening; 125—fastener; 126—second opening; 127—third opening; 128—fourth opening; 1111—first protruding edge; 1112—second protruding edge; 1113—sliding groove; 1114—upper end; 113—side wall.

DETAILED DESCRIPTION

In order to make the objects, features and advantages of the present disclosure more apparent and understandable, the following specific embodiments of the present disclosure are described in detail in conjunction with the accompanying drawings.

It is to be noted that the terms "first", "second" and the like in the specification and claims of the present disclosure and the above-described accompanying drawings are used to distinguish between similar objects and need not be used to describe a particular order or sequence. It should be understood that these serial numbers may be interchanged where appropriate so that the embodiments of the present disclosure described herein can be implemented in an order other than those illustrated or described herein.

In the description of the present disclosure, it should be noted that, unless otherwise expressly provided and qualified, the terms "configure", "mount", "communicate", and "connect" are to be understood in a broad sense. For example, the connection may be a fixed connection, a removable connection, or a one-piece connection; it may be a mechanical connection; it may be a direct connection, an indirect connection through an intermediate medium, or a communication within two elements. For those of ordinary skill in the art, the specific meanings of the above terms in the present disclosure may be understood on a case-by-case basis.

In the description of the present specification, the description of "embodiment", "an embodiment" and "an implementation" means that the specific features, structures, materials or characteristics described in conjunction with the embodiment or implementation are included in at least one embodiment or implementation of the present disclosure. In this specification, schematic expressions of the above terms do not necessarily refer to a same embodiment or implementation. Moreover, the specific features, structures, materials, or characteristics described may be combined in any one or more embodiments or implementations in an appropriate manner.

The present disclosure is described in detail below in conjunction with the accompanying drawings.

In order to solve the above technical problems, as shown in FIGS. 1-6, an adjustable drawer is provided in embodiments of the present disclosure.

The adjustable drawer includes a drawer body 1. The drawer body 1 includes a plurality of connecting elements 11. The plurality of connecting elements 11 join together and form a drawer configuration. At least one of the plurality of connecting elements 11 is movable along a width direction of the drawer body 1 for adjustment. At least one of the plurality of connecting elements 11 is movable along a length direction of the drawer body 1 for adjustment. The drawer body 1 is expandable or contractible.

The adjustable drawer further includes at least one sliding rail 2. The sliding rail 2 is arranged on the drawer body 1 and is used to slidably mount the drawer body 1.

It should be noted that the drawer body 1 is formed by joining the plurality of individual connecting elements 11. One of the connecting elements 11 may be movable along the width direction of the drawer body 1 for adjustment, thereby enabling an expansion or contraction of a width of the drawer body 1. The width direction corresponds to an X-axis direction as depicted in the figures. At least one connecting element 11 may be movable along the length direction of the drawer body 1 for adjustment, thus allowing for an expansion or contraction of a length of the drawer body 1. The length direction corresponds to a Y-axis direction as depicted in the figures. In summary, both the length and the width of the drawer body 1 are adjustable, thereby enabling the adjustable drawer to match various cabinets and enhancing the adaptability of the drawer body 1.

Figure 2:
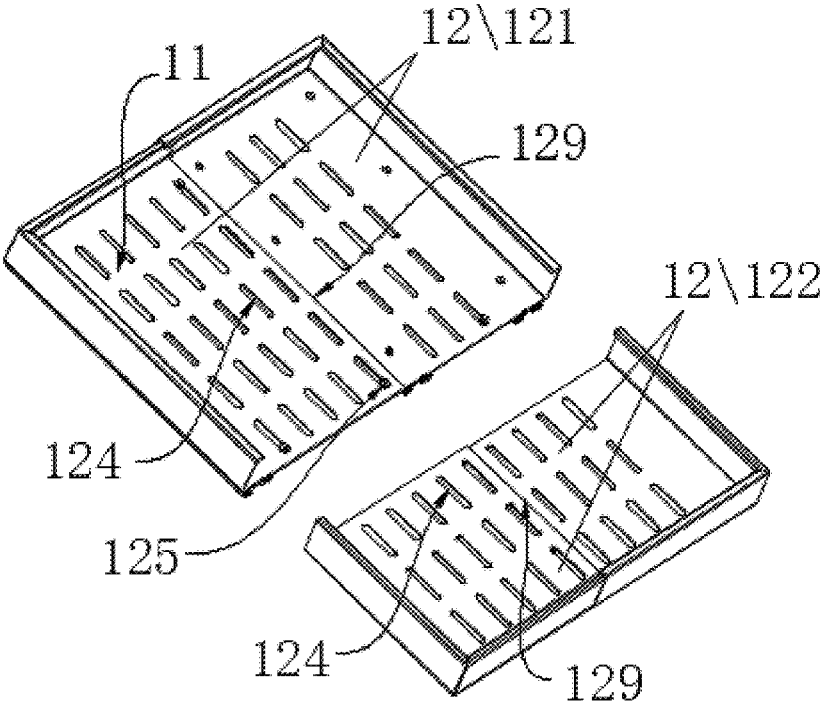
FIG. 2 is an exploded view of the adjustable drawer according to an embodiment of the present disclosure.

In an embodiment of the present disclosure, referring to FIG. 2, the drawer body 1 includes a plurality of connecting portions 12. Each of the plurality of connecting portions 12 includes several connecting elements 11 arranged extending in the width direction. Adjacent portions of at least two of the several connecting elements 11 are stacked and form a first stacking portion 129. The adjacent portions corresponding to the first stacking portion 129 are relatively movable along the width direction. The first stacking portion 129 is capable of expanding or contracting along the width direction. The width of the drawer body 1 is adjustable.

It should be noted that the plurality of connecting elements 11 are defined the plurality of connecting portions 12 based on region partition. A width of each connecting portion 12 equals the width of the drawer body 1. Each connecting portion 12 includes several connecting elements 11 sequentially connected to each other in the width direction. The number of the connecting elements 11 can be two, three, four, etc. Specifically, the number of the connecting elements 11 can be determined according to a size of an accommodation space for installing the drawer body 1. The adjacent portions of the at least two connecting elements 11 are stacked to form the first stacking portion 129, thus enabling the stacking portion to expand or contract by moving the at least two connecting elements 11, thereby adjusting the width of the drawer body 1. The number of the first stacking portion 129 can further be two, three, etc. It is understandable that the greater the number of the first stacking portion 129 is, the larger the adjustment range of the width of the drawer body 1 becomes. However, the width adjustment function of the drawer body 1 can be achieved as long as there is one first stacking portion 129.

Figure 3:
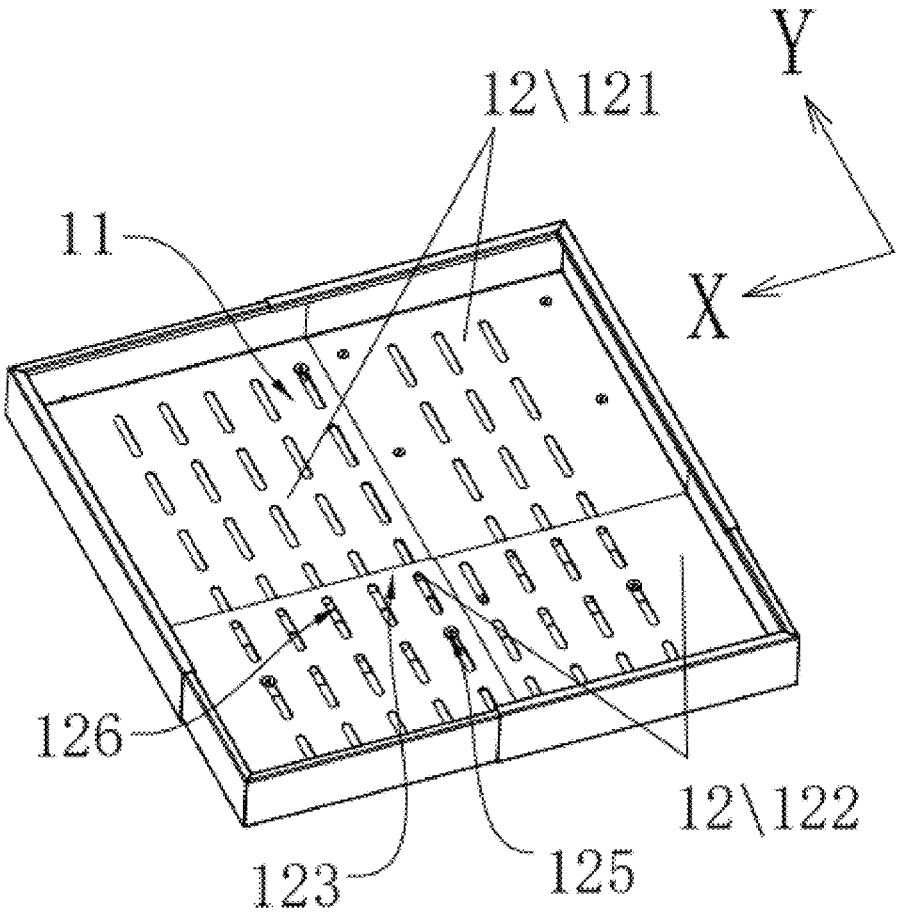
FIG. 3 is another structural view of the adjustable drawer according to an embodiment of the present disclosure.

In an embodiment of the present disclosure, referring to FIG. 3, the plurality of connecting portions 12 are sequentially connected with each other in the length direction. Adjacent parts of at least two of the plurality of the connecting portions 12 are stacked and form a second stacking portion 123. The adjacent parts corresponding to the second stacking portion 123 are relatively movable along the length direction. The second stacking portion 123 is capable of expanding or contracting along the length direction. A length of the drawer body 1 is adjustable.

It should be noted that a total length of the plurality of connecting portions 12 sequentially connected to each other equals the length of the drawer body 1. The number of connecting portions 12 can be two, three, four, etc. Adjacent parts of at least two connecting portions 12 are stacked, thereby enabling the stacking portion to expand or contract by moving the at least two connecting portions 12, thereby adjusting the length of the drawer body 1. The number of the second stacking portion 123 can also be two, three, etc. It can be understood that the greater the number of the second stacking portion 123 is, the larger the adjustment range of the length of the drawer body 1 becomes. However, the length adjustment function of the drawer body 1 can be achieved as long as there is one second stacking portion 123. The number of the connecting elements 11 in each connecting portion 12 can be inconsistent with each other. For example, one connecting portion 12 includes two connecting elements 11, while an adjacent connecting portion 12 includes three connecting elements 11. As long as width ranges of two adjacent connecting portions 12 are overlapped with each other, the two adjacent connecting portions 12 can be connected in the length direction of the drawer body 1. Therefore, a total number of the connecting elements 11 in the drawer body 1 is at least four, and can also be five, six, etc.

Figure 4:
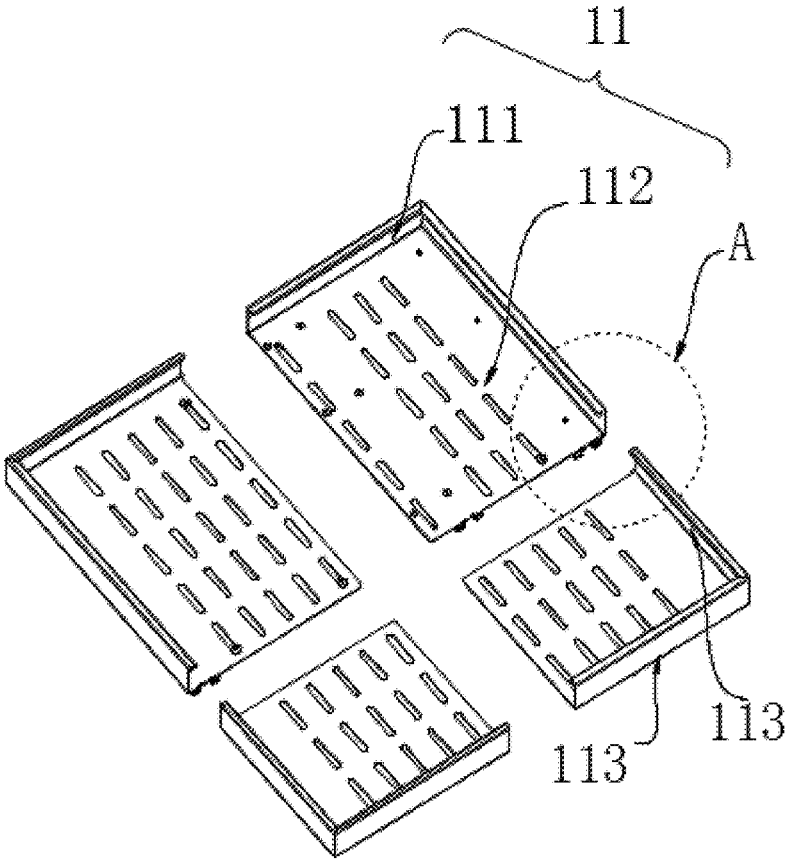
FIG. 4 is another exploded view of the adjustable drawer according to an embodiment of the present disclosure.

In an embodiment of the present disclosure, as shown in to FIGS. 1 and 4, each of the plurality of connecting elements 11 includes a bottom portion 112. A plurality of bottom portions 112 join together and form a bottom face 14 of the drawer body 1. Each of the plurality of connecting elements 11 located at an edge position of the drawer body 1 includes an outer edge 111 protruding from a corresponding bottom portion 112. A plurality of outer edges 111 collectively enclose to form a side face 13 of the drawer body 1.

It should be noted that, in one example, the number of the connecting elements 11 is four, that is, the connecting elements 11 are arranged in two rows and two columns. Each connecting element 11 includes the bottom portion 112 and the outer edge 111. The bottom portions 112 join together to form the bottom face 14 of the drawer body 1. At connecting positions of the connecting elements 11, the connecting elements 11 are arranged in a stacked manner. In this way, regardless of expansion or contraction, the drawer body 1 has a continuous bottom face 14, facilitating the placement of items. The outer edges 111 of the plurality of connecting elements 11 join to form the side face 13 of the drawer body 1. The outer edges 111 are also arranged in the stacked manner at the connecting positions, coordinating with the bottom face 14 for adjustment. In another example, the number of connecting elements 11 is greater, for example, nine. That is, the connecting elements 11 are arranged in three rows and three columns. The connecting element 11 at a central position need only have the bottom portion 112, while the connecting elements 11 at edge positions have the outer edges 111, to join and form the side face 13 of the drawer body 1. Similarly, when the number of the connecting elements 11 is different, the connecting elements 11 can also be arranged in the aforementioned manner to join and form the drawer body 1, further enhancing the flexible applicability of the drawer body 1.

In an embodiment of the present disclosure, with reference to FIG. 2, each of two bottom portions 112 located at the first stacking portion 129 defines a plurality of first openings 124. The plurality of first openings 124 are arranged in the width direction. A fastener 125 passing through a pair of first openings 124 selectively aligned with each other fastens the two bottom portions 112 located at the first stacking portion 129.

It should be noted that the drawer body 1 is adjusted by defining and arranging openings at the stacking positions of the connecting elements 11 and then taking the fastener 125 passing through the selected and aligned openings to fasten the connecting elements 11. Specifically, in an example, the openings are defined in the bottom portions 112 of the connecting elements 11. The bottom portion 112 of each of the two connecting elements 11 located at the first stacking portion 129 defines a plurality of first openings 124. The first openings 124 may be arranged as two, three, four, etc., along the width direction. By selectively aligning two of the first openings 124 and fastening the connecting elements 11 with the fastener 125, the first stacking portion 129 can be selectively expanded or contracted, thereby adjusting the width of the drawer body 1. Specifically, the fastener 125 may be a bolt or other. It is understood that the more the first openings 124 are arranged along the width direction, the larger the adjustment range for the width of the drawer body 1 becomes.

In an embodiment of the present disclosure, as illustrated in FIG. 3, each of at least two bottom portions 112 located at the second stacking portion 123 defines a plurality of second openings 126. The plurality of second openings 126 are arranged in the length direction. The fastener 125 passing through a pair of second openings 126 selectively aligned with each other fastens the at least two bottom portions 112 located at the second stacking portion 123.

It should be noted that, similarly, each of at least two bottom portions 112 located at the second stacking portion 123 defines the plurality of second openings 126. That is to say, for the purpose of achieving length adjustment functionality, the bottom portion 112 of each of the two connecting elements 11 in the second stacking portion 123 has the plurality of second openings 126. Yet, alternatively, the bottom portion 14 of each connecting element 11 in the second stacking portion 123 has the plurality of second openings 126, facilitating enhanced connection stability. Similarly, the second openings 126 may be arranged as two, three, four, etc., along the length direction. By selectively aligning two of the second openings 126 to enable the second stacking portion 123 to expand or contract, the fastener 125 passing through the two of the second openings 126 can fasten the connecting elements 11. It is understood that the more the second openings 126 are arranged along the length direction, the larger the adjustment range for the length of the drawer body 1 becomes.

Figure 5:
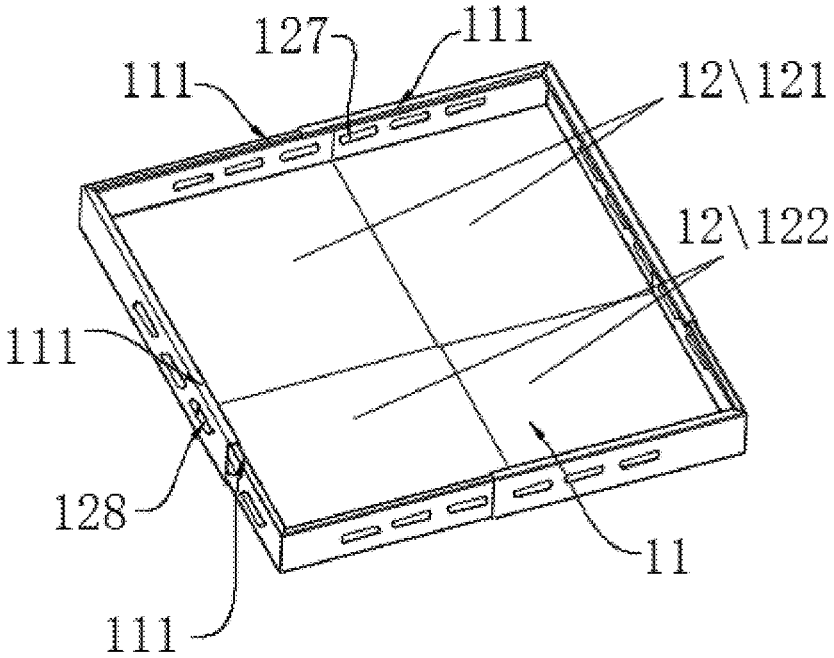
FIG. 5 is a further structural view of the adjustable drawer according to an embodiment of the present disclosure.

In an embodiment of the present disclosure, as illustrated in FIG. 5, two outer edges 111 located at the first stacking portion 129 are slidably nested with each other. Each of the two outer edges 111 defines a plurality of third openings 127. The plurality of third openings 127 are arranged along the width direction. The fastener 125 passing through a pair of third openings 127 selectively aligned with each other fastens the two outer edges 111 located at the first stacking portion 129.

It should be noted that, in another example, the opening is defined in the outer edge 111 of the connecting element 11, i.e., defined in the side face 13 of the drawer body 1. Two outer edges 111 are slidably nested with each other at the first stacking portion 129. Each of the two outer edges 111 has the plurality of third openings 127 arranged along the width direction. By selectively aligning two of the third openings 127 to enable the first stacking portion 129 to expand or contract, the fastener 125 passing through the two of the third openings 127 can fasten the two outer edges 111. It is understood that the number of third openings 127 can be two, three, four, etc. The more the third openings 127 are arranged along the width direction, the larger the adjustment range of the width of the drawer body 1 becomes.

In an embodiment of the present disclosure, referring to in FIG. 5, at least two of the outer edges 111 located at the second stacking portion 123 are slidably nested with each other. Each of the at least two outer edges 111 defines a plurality of fourth openings 128. The plurality of fourth openings 128 are arranged along the length direction. The fastener 125 passing through a pair of fourth openings 128 selectively aligned with each other fastens the at least two outer edges 111 located at the second stacking portion 123.

It should be noted that each of the two outer edges 111 corresponding to the second stacking portion 123 defining the plurality of fourth openings 128 may also achieve the length adjustment function of the drawer body 1. Additionally, forming a plurality of fourth openings 128 in each outer edge 111 corresponding to the second stacking portion 123 ensures a firmer connection. Similarly, the fourth openings 128 may be arranged as two, three, four, etc., along the length direction. By selectively aligning any two of the fourth openings 128, the second stacking portion 123 can expand or contract. After the alignment, the fastener 125 may be inserted into the aligned two fourth openings 128, thus the corresponding two outer edges 111 are fastened. Likewise, the more the fourth openings 128 are arranged along the length direction, the larger the adjustment range of the length of the drawer body 1 becomes.

In an embodiment of the present disclosure, referring to FIG. 1, the adjustable drawer further includes a plurality of slide rails 2. The plurality of slide rails 2 are arranged on the bottom face 14 or the side face 13 of the drawer body 1 along the length direction of the drawer body 1.

It should be noted that there may be the plurality of sliding rails 2. Specifically, the sliding rails 2 are ball-bearing sliding rails 2. The sliding rails 2 are mounted on the drawer body 1. The sliding rails 2 are equipped with adhesive strips and/or define screw holes. Through the adhesive strips, the drawer body 1 can be adhered to a space for drawer installation in a cabinet, and/or by inserting screws into the screw holes, the drawer body 1 can be assembled in the space for drawer installation in the cabinet, thereby achieving the pull-out function of the drawer body 1. The sliding rails 2 can be placed on the bottom face 14 of the drawer body 1, or on the side face 13 of the drawer body 1, as long as the sliding rails 2 are arranged along the length direction and enable the drawer body 1 to be pulled out.

In an embodiment of the present disclosure, as shown in FIGS. 1 and 3, the adjustable drawer further includes a plurality of slide rails 2. The plurality of sliding rails 2 are selectively arranged on at least one of the plurality of connecting portions 12 along the length direction of the drawer body 1.

It should be noted that the drawer body 1 includes a plurality of connecting portions 12. When mounted on the bottom face 14 of the drawer body 1, the sliding rails 2 can be installed on one of the connecting portions 12, or continuously across several connecting portions 12.

In an embodiment of the present disclosure, as illustrated in FIG. 1, the side face 13 of the drawer body 1 may alternatively be hollowed.

Optionally, hollowed patterns or holes can additionally be formed in the side face 13 of the drawer body 1. When the drawer body 1 is used in a cabinet requiring ventilation, such hollowed patterns or holes facilitate air circulation around items stored within the drawer body 1, aiding in dehumidification.

In an embodiment of the present disclosure, with reference to FIG. 2, the number of the plurality of connecting portions 12 is two. The plurality of connecting portions 12 include a first connecting portion 121 and a second connecting portion 122. The first connecting portion 121 includes two connecting elements 11, and the second connecting portion 122 also includes two connecting elements 11.

It should be noted that, specifically, the number of the connecting portions 12 is two. Each connecting portion 12 includes two connecting elements 11. Four connecting elements 11 represent the minimum quantity for achieving the adjustment of the width and length of the drawer body 1. This design is convenient and swift in assembly and adjustment and easy access by the user.

Figure 6:
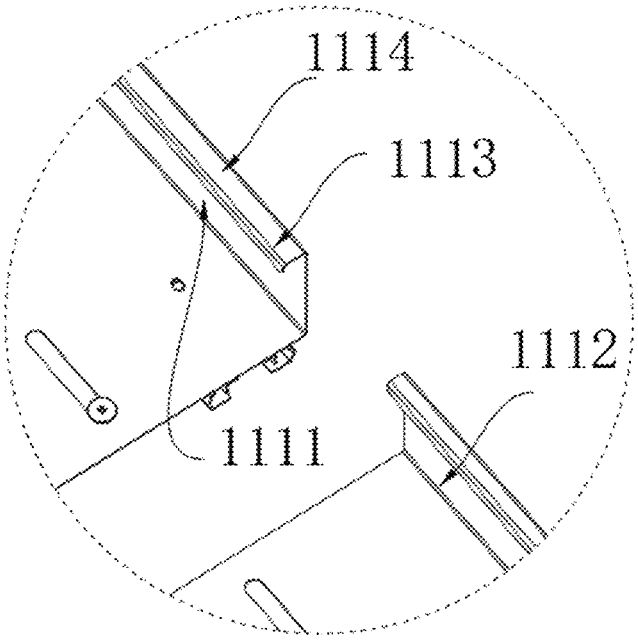
FIG. 6 is an enlarged view of a portion A in FIG. 4.

In an embodiment of the present disclosure, with reference to FIGS. 4 and 6, each of the plurality of connecting elements 11 includes a bottom portion 112 and an outer edge 111. The bottom portion 112 is flat, and the outer edge 111 is protruding from the bottom portion 112. The outer edge 111 includes two side walls 113 extending at an angle and collectively enclosing to form a side face 13 of the drawer body 1. The bottom portion 112 of each of the plurality of connecting elements 11 defines a first opening 124 and a second opening 126. The first opening 124 and the second opening 126 are arranged in at least two rows and two columns. The first opening 124 and the second opening 126 are arranged for selectively accommodating a fastener 125 when adjacent connecting elements 11 are stacked to fasten the adjacent connecting elements 11.

It should be noted that when there are four connecting elements 11, and each connecting element 11 includes the bottom portion 112 and the outer edge 111. Each outer edge 111 includes two side walls 113 extending at a right angle, thereby forming four corners respectively and enclosing to form the side face 13 of the drawer body 1. The bottom portion 112 of each connecting element 11 includes the first opening 124 and the second opening 126. The first opening 124 is used for width adjustment, and the second opening 126 is used for length adjustment. In this way, the first opening 124 and the second opening 126 in each connecting element 11 are arranged in two rows and two columns to achieve the adjustment function. Notably, an opening at an intersection position serves as both the first opening 124 and the second opening 126. Alternatively, the first openings 124 and the second openings 126 may be arranged in three rows and three columns, or seven rows and seven columns, or others. The greater the number of rows and columns is, the larger the adjustment range becomes.

In an embodiment of the present disclosure, with reference to FIGS. 4 and 6, each of two adjacent outer edges 111 is a sheeting structure and two adjacent outer edges 111 are arranged in a snug sliding fit.

It should be noted that, in one example, each of the adjacent two outer edges 111 may be arranged as a sheeting structure instead of being arranged with a sliding groove 1113 as described below, and still capable of achieving the function of sliding relative to each other, thus simplifying an overall structure of the drawer body 1.

In an embodiment of the present disclosure, as shown in FIGS. 4 and 6, two adjacent outer edges 111 include a first protruding edge 1111 and a second protruding edge 1112. An upper end 1114 of the first protruding edge 1111 is folded and defines a sliding groove 1113. The second protruding edge 1112 is slidably received in the sliding groove 1113 and connected with the first protruding edge 1111 in a snap fit.

It should be noted that, in an example, the first protruding edge 1111 and the second protruding edge 1112 are sequentially arranged, with the upper end 1114 of the first protruding edge 1111 folded back to form a sliding groove 1113, thereby enabling slidably nested connection between the first protruding edge 1111 and the second protruding edge 1112. Specifically, the upper end 1114 of each of the first protruding edge 1111 and the second protruding edge 1112 is folded back to form the sliding groove 1113, allowing the first protruding edge 1111 and the second protruding edge 1112 to be nested into each other. It can be understood that the sliding groove 1113 may be a groove in a shape of a rectangular prism formed by folding back a corresponding protruding edge or a cylinder formed by bending the corresponding protruding edge, as long as the groove facilitates sliding and nesting.

In an embodiment of the present disclosure, as shown in FIGS. 1 and 3, an area of the first connecting portion 121 is greater than an area of the second connecting portion 122. The adjustable drawer further includes a plurality of sliding rails 2. The plurality of sliding rails 2 are arranged on the first connecting portion 121 along the length direction of the drawer body 1.

It should be noted that specifically, the area of the first connecting portion 121 is greater than that of the second connecting portion 122. During assembly, the first connecting portion 121 is positioned on the outside, and the sliding rails 2 are mounted onto the first connecting portion 121, thus allowing the sliding rails 2 to have a greater length, enabling the drawer body 1 to be pulled out to a larger extent.

In an embodiment of the present disclosure, with reference to FIGS. 2-3, each of the first opening 124 and the second opening 126 is an elongated oval hole or a circular hole.

Specifically, the first opening 124 and the second opening 126 are elongated oval holes. The elongated oval holes may extend along the length direction or extend along the width direction. The elongated oval holes can effectively disperse stress, enhancing the durability and stability of the connecting positions of the connecting elements 11. Alternatively, the first opening 124 and the second opening 126 may also be circular holes or other shaped openings.

It should be noted that the various embodiments not listed above formed by the combination of the aforesaid technical features with each other are considered to be within the scope recorded in the specification of the present disclosure. Moreover, to a person of ordinary skill in the art, improvements or transformations may be made in accordance with the above description, and all such improvements and transformations shall fall within the scope of protection of the appended claims of the present disclosure.

What is claimed is:

1. An adjustable drawer, comprising:

a drawer body, comprising a plurality of connecting elements and a plurality of sliding rails, wherein the plurality of connecting elements join together and form a drawer configuration, at least one of the plurality of connecting elements is movable along a width direction of the drawer body for adjustment, at least one of the plurality of connecting elements is movable along a length direction of the drawer body for adjustment, and the drawer body is expandable or contractible;

wherein the plurality of connecting elements comprises at least one first connecting element and at least one second connecting element;

wherein each of the at least one first connecting element has a bottom wall and a first side wall protruding and extending from the bottom wall of the at least one first connecting element; the first side wall has a first upper end arranged with a first bent portion bending towards the bottom wall of the at least one first connecting element, a first sliding groove is defined between the first bent portion and the first side wall and has a first groove width;

each of the at least one second connecting element has a bottom wall and a second side wall protruding and extending from the bottom wall of the at least one second connecting element; the second side wall has a second upper end arranged with a second bent portion bending towards the bottom wall of the at least one second connecting element, a second sliding groove is defined between the second bent portion and the second side wall and has a second groove width, the second groove width is less than the first groove width; and when the plurality of connecting elements join together, the second bent portion is slidably received in the first sliding groove;

two connecting elements of the plurality of connecting elements are arranged with and connected to each other, the two connecting elements are partially stacked with each other to form a first stacking portion; each of the two connecting elements has the bottom wall, the bottom wall defines a plurality of first openings, the plurality of first openings are arranged in the width direction or in the length direction; the two connecting elements are secured to each other by selectively aligning and communicating one of the plurality of first openings in the bottom wall of one of the two connecting elements at the first stacking portion with one of the plurality of first openings in the bottom wall of the other one of the two connecting elements at the first stacking portion.

2. The adjustable drawer as claimed in claim 1, wherein the drawer body comprises a plurality of connecting portions, each of the plurality of connecting portions comprises several connecting elements arranged extending in the width direction, adjacent portions of at least two of the several connecting elements are stacked and form the first stacking portion, the adjacent portions corresponding to the first stacking portion are relatively movable along the width direction, the first stacking portion is capable of expanding or contracting along the width direction, and a width of the drawer body is adjustable.

3. The adjustable drawer as claimed in claim 2, wherein the plurality of connecting portions are sequentially connected with each other in the length direction, adjacent parts of at least two of the plurality of the connecting portions are stacked and form a second stacking portion, the adjacent parts corresponding to the second stacking portion are relatively movable along the length direction, the second stacking portion is capable of expanding or contracting along the length direction, and a length of the drawer body is adjustable.

4. The adjustable drawer as claimed in claim 3, wherein a plurality of bottom walls of the plurality of connecting elements join together and form a bottom face of the drawer body, and each of the plurality of connecting elements located at an edge position of the drawer body comprises an outer edge protruding from a corresponding bottom wall, a plurality of outer edges collectively enclose to form a side face of the drawer body.

5. The adjustable drawer as claimed in claim 4, wherein a fastener passing through a pair of the first openings that are selectively aligned with each other fastens the two bottom walls located at the first stacking portion.

6. The adjustable drawer as claimed in claim 5, wherein each of at least two bottom walls located at the second stacking portion defines a plurality of second openings, the plurality of second openings are arranged in the length direction, and the fastener passing through a pair of second openings selectively aligned with each other fastens the at least two bottom walls located at the second stacking portion.

7. The adjustable drawer as claimed in claim 6, wherein two outer edges located at the first stacking portion are slidably nested with each other, and each of the two outer edges defines a plurality of third openings, the plurality of third openings are arranged along the width direction, and the fastener passing through a pair of third openings selectively aligned with each other fastens the two outer edges located at the first stacking portion.

8. The adjustable drawer as claimed in claim 7, wherein at least two of the outer edges located at the second stacking portion are slidably nested with each other, and each of the at least two outer edges defines a plurality of fourth openings, the plurality of fourth openings are arranged along the length direction, and the fastener passing through a pair of fourth openings selectively aligned with each other fastens the at least two outer edges located at the second stacking portion.

9. The adjustable drawer as claimed in claim 1, wherein the number of the at least one first connecting element is two, and the number of the at least one second connecting element is two;

when the plurality of connecting elements join together and form the drawer configuration, both of the two second connecting elements are arranged above the two first connecting elements and on a side of the two first connecting elements away from the plurality of sliding rails.

10. An adjustable drawer, comprising:

a drawer body, comprising a plurality of connecting elements, wherein the plurality of connecting elements join together and form a drawer configuration, at least one of the plurality of connecting elements is movable along a width direction of the drawer body for adjustment, at least one of the plurality of connecting elements is movable along a length direction of the drawer body for adjustment, and the drawer body is expandable or contractible;

wherein each of the plurality of connecting elements defines an array of openings that are dis-communicated with each other at a bottom surface of each of the plurality of connecting elements; and the array comprises a plurality of rows and a plurality of columns, each of the plurality of rows comprises a plurality of openings that are dis-communicated with each other in a row direction, each of the plurality of columns comprises a plurality of openings that are dis-communicated with each other in a column direction; the column direction is perpendicular to the row direction; the plurality of connecting elements are connected to each other by inserting fasteners into at least one of the plurality of openings.

11. The adjustable drawer as claimed in claim 10, wherein the adjustable drawer comprises a plurality of connecting portions; each of the plurality of connecting portions is formed by at least part of the plurality of connecting elements, are arranged in the width direction of the drawer body, being connected to each other; the adjustable drawer further comprises a plurality of sliding rails, the plurality of sliding rails are selectively arranged on at least one of the plurality of connecting portions along the length direction of the drawer body.

12. The adjustable drawer as claimed in claim 11, wherein the number of the plurality of connecting portions is two, the plurality of connecting portions comprise a first connecting portion and a second connecting portion, the first connecting portion comprises two connecting elements, and the second connecting portion comprises two connecting elements.

13. The adjustable drawer as claimed in claim 12, wherein each of the plurality of connecting elements further comprises an outer edge, the bottom wall is flat, the outer edge is protruding from the bottom wall, the outer edge comprises two side walls extending at an angle and collectively enclosing to form a side face of the drawer body.

14. The adjustable drawer as claimed in claim 13, wherein each of two adjacent outer edges is a sheeting structure and two adjacent outer edges are arranged in a snug sliding fit.

15. The adjustable drawer as claimed in claim 13, wherein two adjacent outer edges comprise a first protruding edge and a second protruding edge, an upper end of the first protruding edge is folded and defines a sliding groove, the second protruding edge is slidably received in the sliding groove and connected with the first protruding edge in a snap fit.

16. The adjustable drawer as claimed in claim 12, wherein an area of the first connecting portion is greater than an area of the second connecting portion, the adjustable drawer further comprises a plurality of sliding rails, the plurality of sliding rails are arranged on the first connecting portion along the length direction of the drawer body.

17. An adjustable drawer, comprising:

a drawer body, comprising a plurality of connecting elements and a plurality of sliding rails, wherein the plurality of connecting elements join together and form a drawer configuration, at least one of the plurality of connecting elements is movable along a width direction of the drawer body for adjustment, at least one of the plurality of connecting elements is movable along a length direction of the drawer body for adjustment, and the drawer body is expandable or contractible;

wherein the plurality of connecting elements comprises at least one first connecting element and at least one second connecting element;

wherein each of the at least one first connecting element has a first bottom wall and a first side wall protruding and extending from the first bottom wall; the first side wall has a first upper end arranged with a first bent portion bending towards the first bottom wall, a first sliding groove is defined between the first bent portion and the first side wall, and the first sliding groove has a first groove width;

each of the at least one second connecting element has a second bottom wall and a second side wall protruding and extending from the second bottom wall; the second side wall has a second upper end arranged with a second bent portion bending towards the second bottom wall, a second sliding groove is defined between the second bent portion and the second side wall, the second sliding groove has a second groove width, the second groove width is less than the first groove width; and when the plurality of connecting elements join together, the second bent portion is slidably received in the first sliding groove;

each of the plurality of connecting elements defines an array of openings that are dis-communicated with each other at a bottom surface of each of the plurality of connecting elements; and the array comprises a plurality of rows and a plurality of columns, each of the plurality of rows comprises a plurality of openings that are dis-communicated with each other in a row direction, each of the plurality of columns comprises a plurality of openings that are dis-communicated with each other in a column direction.

* * * * *